US009754567B1

(12) United States Patent
Griffin

(10) Patent No.: US 9,754,567 B1
(45) Date of Patent: Sep. 5, 2017

(54) SYSTEM AND METHOD FOR TRANSPORTATION AND PERFORMANCE OF MUSICAL DRUMS

(71) Applicant: Paul William Griffin, Kenosha, WA (US)

(72) Inventor: Paul William Griffin, Kenosha, WA (US)

( * ) Notice: Subject to any disclaimer, the term of this patent is extended or adjusted under 35 U.S.C. 154(b) by 0 days.

(21) Appl. No.: 15/266,728

(22) Filed: Sep. 15, 2016

(51) Int. Cl.
*G10G 5/00* (2006.01)

(52) U.S. Cl.
CPC ..... *G10G 5/00* (2013.01); *G10G 5/005* (2013.01)

(58) Field of Classification Search
CPC ..... G10G 5/005
USPC ..... 84/411 R, 421
See application file for complete search history.

(56) References Cited

U.S. PATENT DOCUMENTS 4,333,682 A 6/1982 Iser
4,579,229 A 4/1986 Porcaro et al.
4,593,596 A 6/1986 Gauger
5,464,236 A 11/1995 Benting et al.
6,096,955 A 8/2000 Ter Heide
6,485,037 B1 11/2002 Sulcer, Jr.
6,550,860 B2 4/2003 Lombardi
6,610,916 B1 8/2003 Torrez
6,967,271 B1 11/2005 Schaff
7,281,720 B1 10/2007 Richards
7,287,766 B2 10/2007 Kilday et al.
7,378,584 B2 5/2008 Frank et al.
8,657,129 B2 2/2014 Marks et al.
8,669,452 B2 3/2014 Waitzman, III et al.
8,678,403 B1 3/2014 McCleave
2006/0225559 A1* 10/2006 Frank ..... G10G 5/005 84/421

FOREIGN PATENT DOCUMENTS

GB 2273091 A * 6/1994 ..... B62B 1/264

* cited by examiner

*Primary Examiner* — Kimberly Lockett
(74) *Attorney, Agent, or Firm* — Seyfarth Shaw LLP

(57) ABSTRACT

A drum cart for supporting and transporting a drum set between locations. The drum cart includes support arms, a handle, wheels and a support bracket adapted to releasably couple a bass drum to the drum cart and place the bass drum into a performance position by lying the drum cart on the ground horizontally.

9 Claims, 6 Drawing Sheets

SYSTEM AND METHOD FOR TRANSPORTATION AND PERFORMANCE OF MUSICAL DRUMS

FIELD OF THE INVENTION

The invention relates generally to dollies or carts for transporting musical drum sets and, in particular, to a cart adapted to both transport a drum set to a performance venue as well as hold and support the drum set during performance.

BACKGROUND

Currently, multiple trips are required to move a drum set or percussion set from home to the place of performance and back. Stand drum set-ups require the user to assemble and then disassemble a number of components, including but not limited to stands required to hold drums, cymbals and other percussion instruments. Each assembly or disassembly of the drum set can take upwards of half an hour or more, depending on the size and number of components in the drum set. Inevitably, multiple trips are required to then move the disassembled components from the home into the vehicle for transport, then from the vehicle to the place of performance where the set is then reassembled.

Additionally, when preparing for a gig, often the drum set will be assembled in a performance staging area while other gigs are performing on stage. This permits the drummer to place each of the components into their proper playing position which frequently varies from drummer to drummer. There is no present system which permits a user to move the components of an entire drum set, once assembled in their proper playing position, from the staging area to the performance area. Rather, the drummer must make multiple trips from staging to performance areas, carrying individual components and then replacing those components in their proper playing position.

Accordingly, there is a need for a system that permits a band member or stagehand to transport all pieces of a drum set in only one trip. Additionally, none of the present drum transportation systems provide easy portability of an entire drum set, once assembled in their proper playing position, from the staging area to the performance.

SUMMARY

In accordance with an aspect of the invention, the drum cart broadly includes support arms, a handle disposed between the support arms, a base and wheels for transporting the cart between locations. The drum cart further includes support brackets disposed between the lower end of the support arms and having channels to receive the tension rods of a base drum to semi-permanently affix the base drum to the drum cart. In transport, the drum cart and bass drum are vertical. To place the drum cart and into performance position on stage or in a staging area, the drum cart is lowered horizontally to the ground so that the wheels and handle rest on the ground and the bass drum head faces outwardly away from the drummer.

The drum cart further includes T-joints attached to the support arms and can receive the stands of additional drum components or extension arms for attaching additional drum components. The T-joints are moveable around the frame of the drum cart to permit a drummer to place to different drum set components in the drummer's preferred playing position. The T-joints also permit the extension arms or drum stands to be rotated in different directions when the drum has been removed in order to keep the extension arm or stand within the footprint of the drum cart and permit easier transport.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 1:
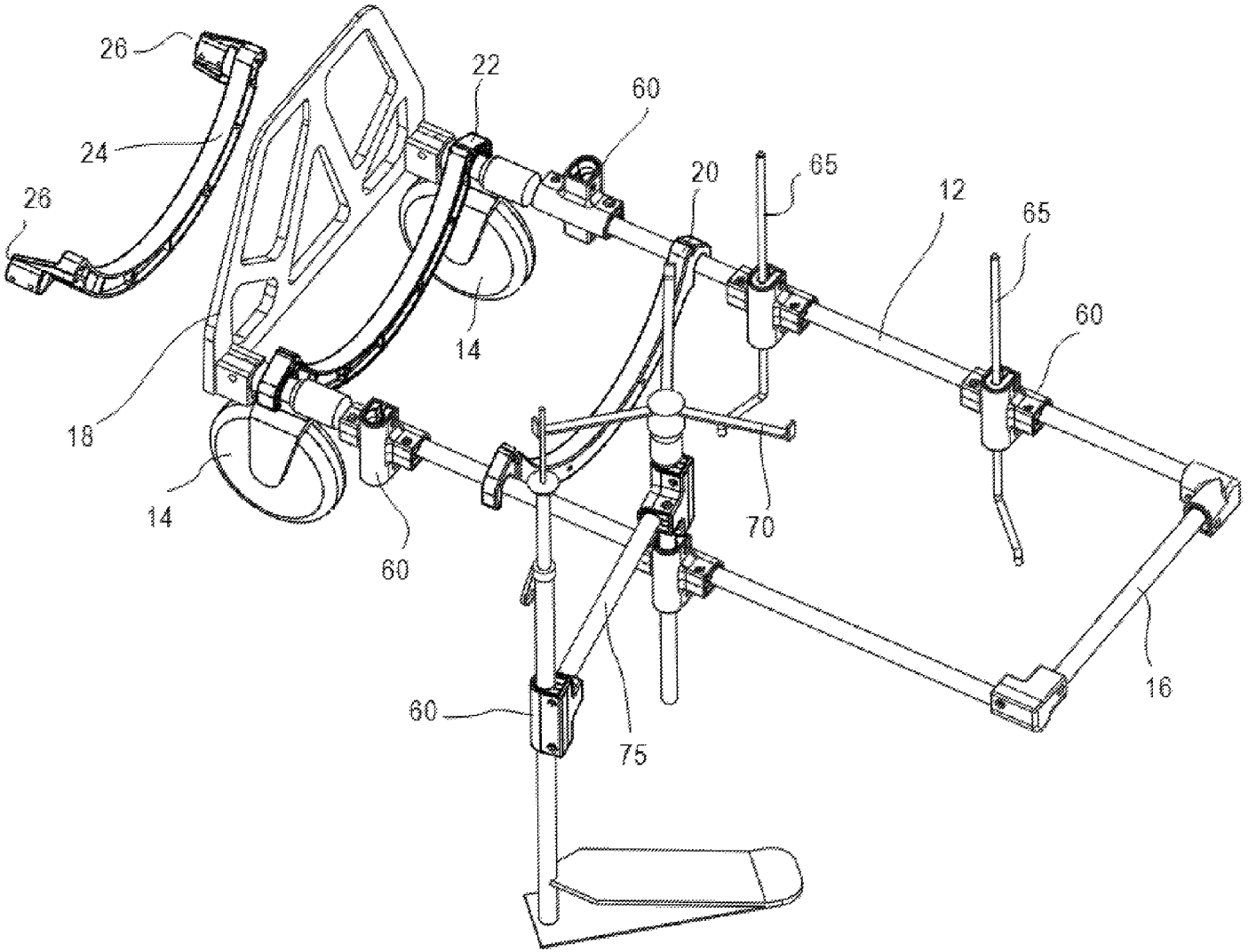
FIG. 1 is perspective view of a drum support system in the performance position, according to an embodiment of the present invention.

While the present invention is susceptible of embodiments in many different forms, there is shown in the drawings, and will herein be described in detail, embodiments, including a preferred embodiment, of the invention with the understanding that the present disclosure is to be considered as an exemplification of the principles of the invention, and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

Referring to FIG. 1, an embodiment of a drum cart 10 of the present invention is shown. The drum cart 10 includes a frame having two generally straight support arms 12, a flat base 18 disposed between the support arms near a set of wheels 14, and a handle 16 disposed between the support arms 12 opposite the base 18. The base 18 is optionally removable. In an embodiment, the cart contains a single wheel disposed between the support arms 12.

Figure 2:
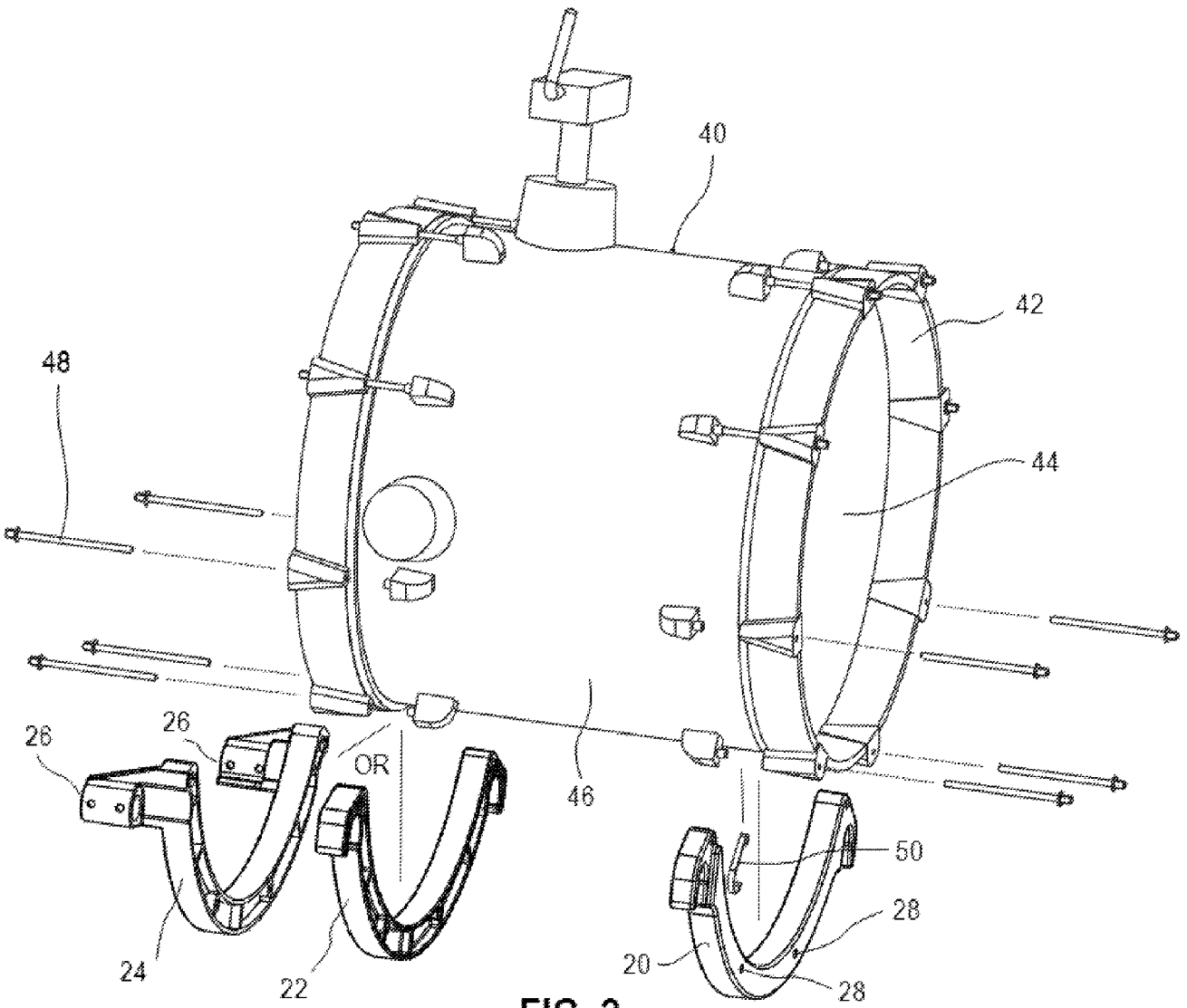
FIG. 2 is an exploded, perspective view of a bass drum and bass drum support brackets, according to an embodiment of the present invention.

Rear and front support brackets 20, 22 near the base 18 are adapted to receive a bass drum via the bass drum's tension rods, as depicted in FIG. 2. The support brackets 20, 22 are generally arcuate in shape to mirror the cylindrical body of a bass drum. Front support bracket 22 is removable and used in an embodiment when the drum cart includes the base 18. Alternatively, in an embodiment, the base 18 can be removed. When the base 18 is removed, front support bracket 24, which includes a plurality of feet 26 for resting the drum cart 10 on the ground, is attached.

Figure 3:
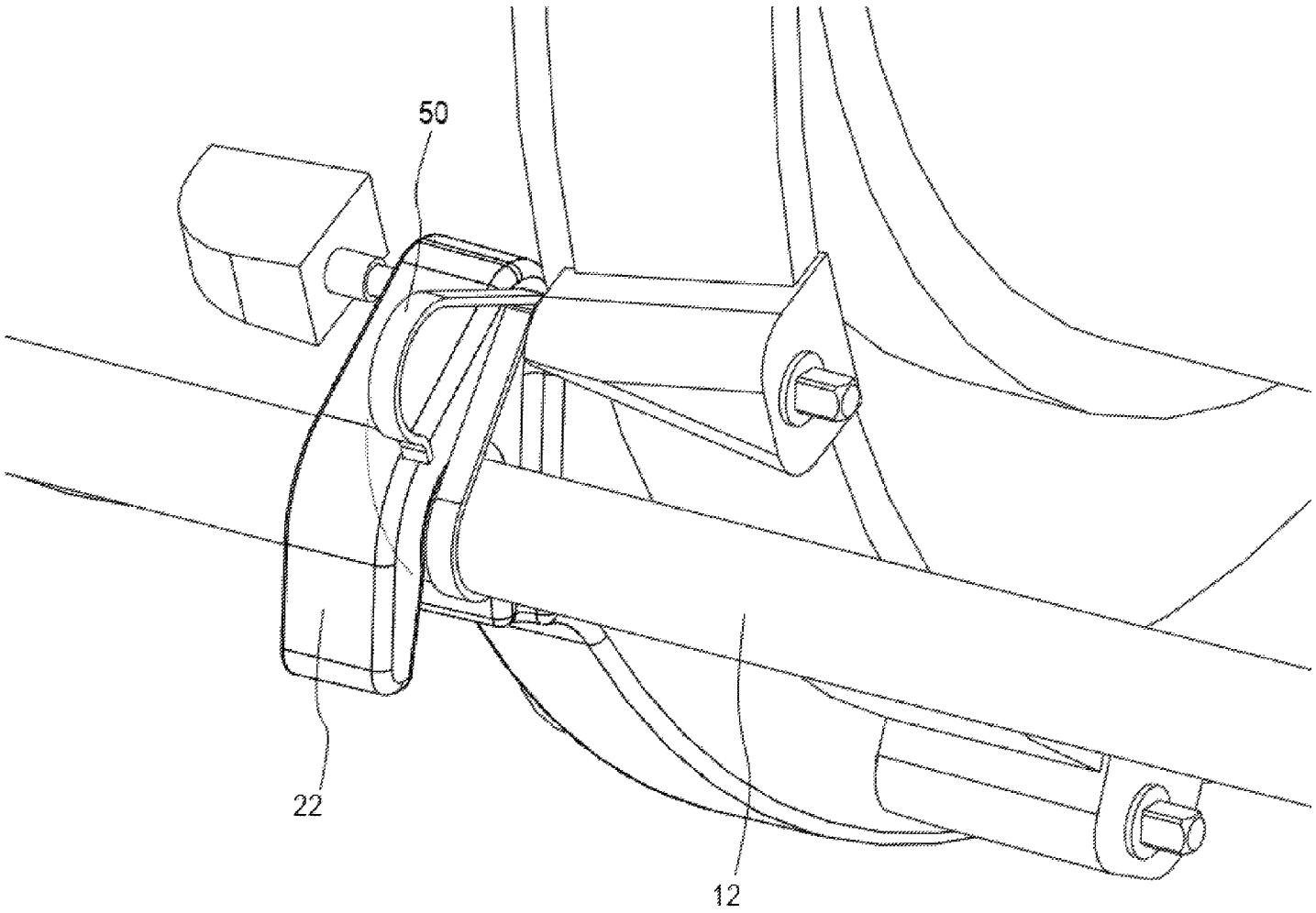
FIG. 3 is a perspective view of a spring clip within the bass drum support brackets depicted in FIG. 2.

Referring to FIG. 2, a bass drum 40 includes drum hoop 42, typically made of metal, wood, or other material, that is used to hold the drum head 44 against the drum shell 46 via tension rods 48 inserted through claw hooks that hold the drum hoop 42. To attach the bass drum 40 to the drum cart 10, the tension rods 48 are removed and channels 28 of support brackets 20, 22 (or 24) are respectively aligned with the holes in the flange of the drum hoop 42. The tension rods 48 are then respectively reinstalled through the flange holes and the channels 28 of support brackets 20, 22. Additionally, a tension rod 48 is inserted through a spring clip 50 disposed on the support brackets 20, 22, as show in FIG. 3. The spring clip is loaded to snap over one of the support arms 12, thereby releasably coupling the bass drum to the lower portion of the drum cart 10. Thus, once releasably coupled, the bass drum 40 can only be removed from the drum support 10 by disassembling and removing the tension rods.

The cylindrical body of the bass drum 40 is mounted co-axial with the support arms 12. When assembled the drum head 44 lies flat against the base 18 of the cart. As such, when the drum cart 10 is wheeled in a vertical or semi-vertical position, the bass drum 40 is also in a vertical position. At the staging area or performance location, the drum cart 10 is lowered horizontally so wheels 14 and handle 16 rest on the ground, placing the bass drum in a normal, horizontal playing position so it can be played, with the drumhead 44 facing toward the spectators, as seen in FIGS. 5 and 6.

Figure 4:
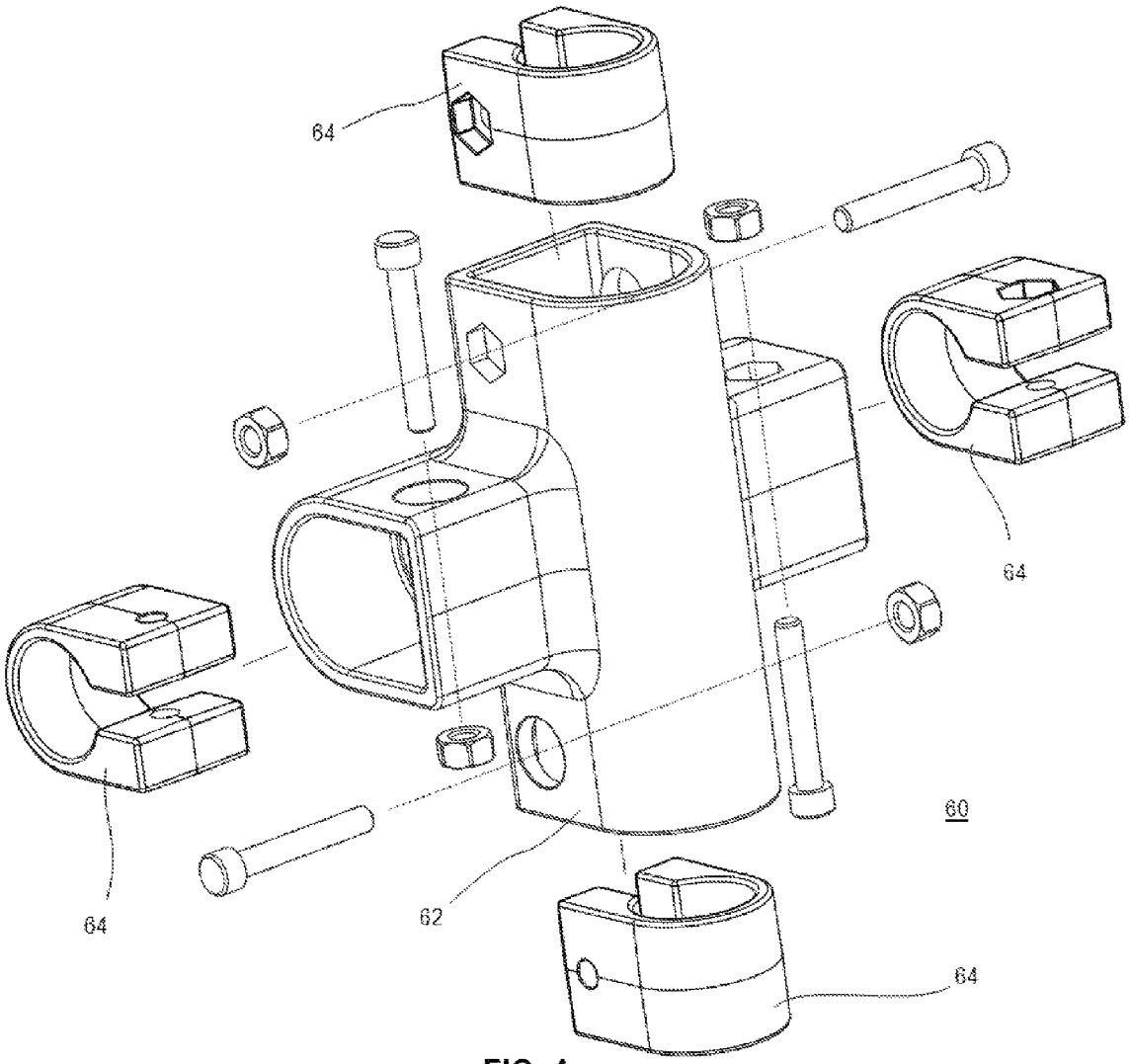
FIG. 4 is an exploded view of T-shaped brackets, according to an embodiment of the invention.

In an embodiment, the drum cart 10 can include optionally removable T-joints 60 respectively coupled to the support arms 12 via clamps 64 disposed within each limb of the T-joint, such as those shown in FIG. 4. The T-joints 60 are adapted to permit fastening of other drum components to the drum cart 10. For example, a floor tom can be attached to the drum cart 10 by connecting the T-joint 60 to an existing floor tom's support legs 65 mounted at a 90-degree angle to the support arms 12, shown in FIG. 1. Additionally, cymbals can be attached to the drum cart 10 by connecting the T-joints 60 to cymbal stands at 90-degree angles to the support arms 12. Cymbal stands may, in some cases, also be self-supported by the bass drum 40. A snare drum stand 70 may be connected at a 90-degree angle to the support arms 12 to permit attachment of a snare drum. For assembling a hi-hat, an extension arm 75 and additional T-joint 60 are attached to a hi-hat stand, the extension arm 75 thereby facilitating the positioning of the hi-hat into the proper arrangement for performance. During transport, the hi-hat extension arm 75 is rotated so that it is co-axial with the vertical support arms, as depicted in FIG. 5.

Figure 5:
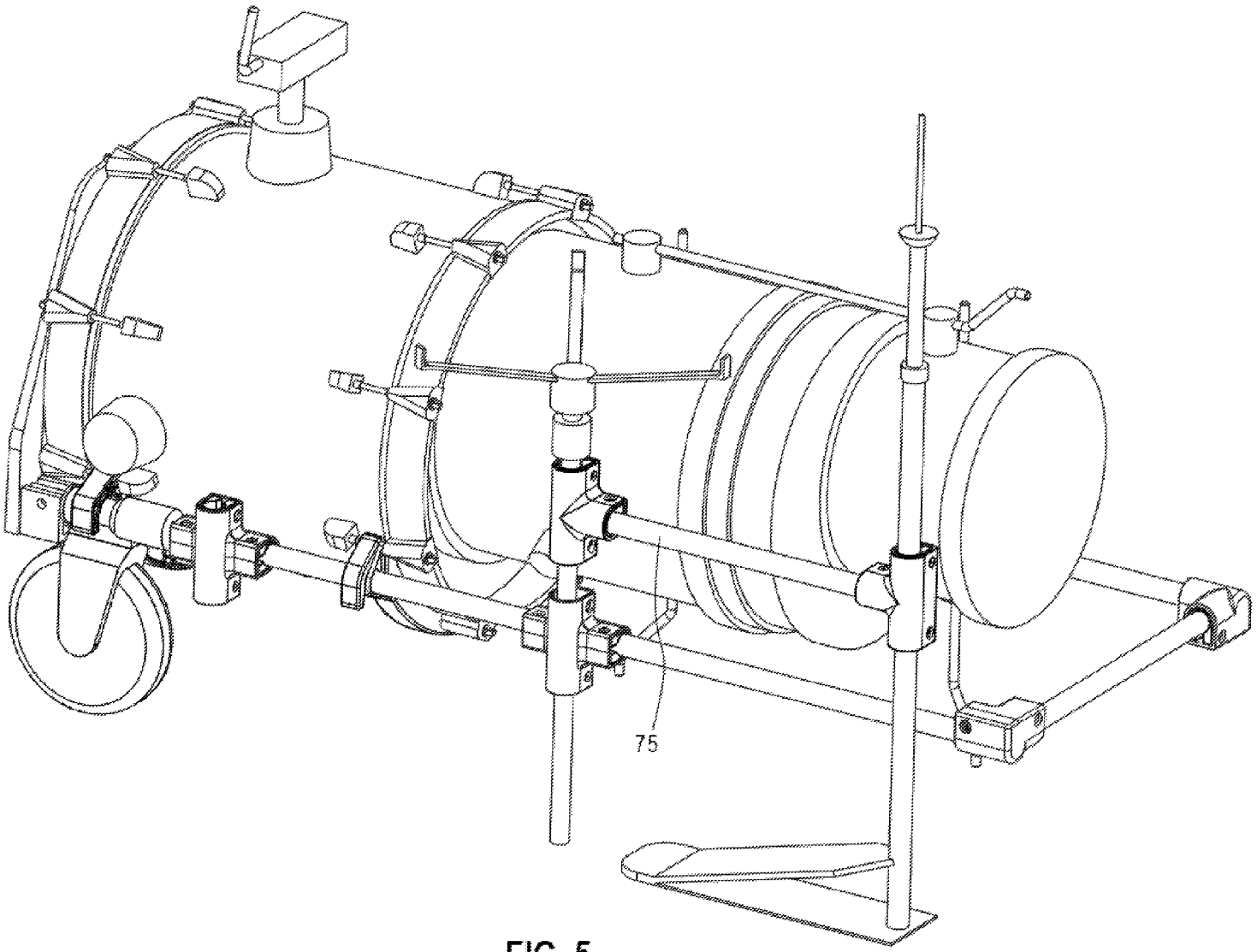
FIG. 5. is side view of the drum support system depicted in FIG. 1, in the transport position and including a drum set.
Figure 6:
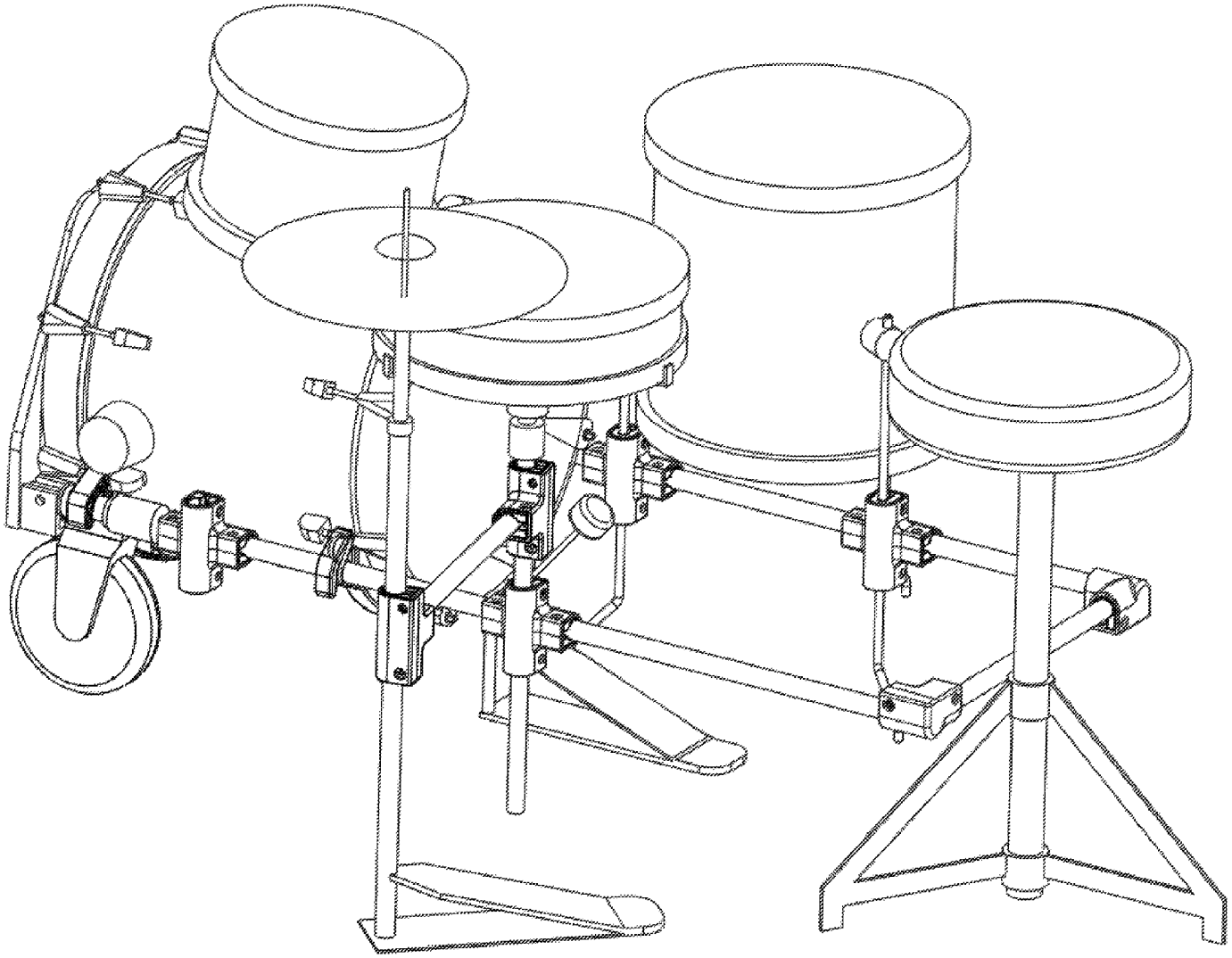
FIG. 6 is a side view of the drum support system depicted in FIG. 1, in the performance position and including a drum set.

Once the desired components of the drum set are properly coupled to the drum cart 10, the drum set can be configured in either the transport position, as shown in FIG. 5, or the performance position, as seen in FIG. 6. In transport, all but the bass drum of the drum set components are removed from their performance position on their respective stands and stacked on the bass drum between the support arms. If an extension arm has been coupled to the drum cart 10 via a T-joint, such as the extension arm attached to a hi-hat stand, the extension arm can be radially rotated so that the arm is parallel to the support arms 12 defining the footprint of the drum cart. Thus, all drum components are contained within the footprint of the frame, permitting easy transport and storage. A band member or stage hand then grasps the handle 16 to wheel the drum cart 10 much like a standard dolly or wheelbarrow, depending upon the configuration.

Upon arrival at the staging area in the transport position, the drum cart 10 is placed with the support arms 12 horizontal and parallel with the floor, with the handle and wheels resting on the floor. The bass drum 40 is thereby placed into the performance position with the drum head 44 facing away from the drummer. Any drum stands or cymbal stands attached to T-joints are raised or lowered to their desired height. Attached extension arms 75 are outwardly rotated so as to place the attached drum stand into its proper position. The remaining drum components, such as a cymbal, hi-hat, floor tom or snare drum, can then be easily assembled on their respective stands and placed into the drummer's preferred performance positions. The footprint of the drum set in its performance position is then established. Because all components are assembled and semi-permanently fixed to the frame in the performance position, the present invention further permits simple transport of the entire drum set within the footprint by simply lifting the handle slightly off the ground and rolling the drum cart via the wheels from the staging area to the performance area without having to reassemble the set on stage, or disassemble the set before removing the set from the stage.

While the invention has been described with respect to specific examples including presently preferred modes of carrying out the invention, those skilled in the art will appreciate that there are numerous variations and permutations of the above described systems and techniques that fall within the spirit and scope of the invention.

What is claimed is:

1. A cart for transporting a drum set, comprising:

a handle, first and second support arms disposed adjacent to the handle, a wheel respectively disposed adjacent to the first and second support arms opposite the handle, a support bracket disposed between the first and second support arms and adapted to couple a drum to the drum cart, and first and second T-shaped joints respectively disposed on the first and second support arms and adapted to facilitate releasably coupling a drum set component to the drum cart.

2. The cart of claim 1, wherein the drum is coupled to the drum cart via tension rods.

3. The cart of claim 1, further comprising a spring clip disposed on the support bracket to releaseably couple the support bracket and drum to the support arms.

4. The cart of claim 1, further comprising an extension arm coupled to the first T-shaped joint and adapted to facilitate coupling of the drum set component.

5. The cart of claim 4, wherein the drum set component is a hi-hat stand.

6. The cart of claim 4, wherein the extension arm is rotatably moveable to permit positioning the extension arm generally parallel the first support arm.

7. The drum cart of claim 1, further comprising a plurality of drum set components.

8. The drum cart of claim 7, further comprising first and second extension arms respectively coupled to the first and second T-shaped joints, each extension arm is adapted to facilitate coupling of the drum set components.

9. A cart for transporting a drum set including percussion instruments, the cart comprising:

a handle, support arms disposed adjacent the handle, at least one wheel disposed adjacent the support arms and opposite the handle, a support bracket disposed between the support arms and adapted to fasten a percussion instrument to the cart, and a T-shaped joint disposed on the support arms, the T-shaped joint adapted to receive an extension arm, wherein the extension arm is rotatably moveable to permit positioning the extension arm generally parallel the support arms in a transport position.

* * * * *